US009752242B2

(12) United States Patent
Abbott et al.

(10) Patent No.: US 9,752,242 B2
(45) Date of Patent: Sep. 5, 2017

(54) LEVELING ADDITIVES FOR ELECTRODEPOSITION

(71) Applicant: Xtalic Corporation, Marlborough, MA (US)

(72) Inventors: Joshua Garth Abbott, Marlborough, MA (US); Evgeniya Freydina, Acton, MA (US)

(73) Assignee: Xtalic Corporation, Marlborough, MA (US)

( * ) Notice: Subject to any disclaimer, the term of this patent is extended or adjusted under 35 U.S.C. 154(b) by 124 days.

(21) Appl. No.: 14/489,107

(22) Filed: Sep. 17, 2014

(65) Prior Publication Data

US 2016/0076161 A1 Mar. 17, 2016

(51) Int. Cl.

| | |
|---|---|
| ***C25D 5/18*** | (2006.01) |
| ***C25D 3/66*** | (2006.01) |
| ***C25D 3/44*** | (2006.01) |
| ***C25C 3/06*** | (2006.01) |
| ***C25D 3/56*** | (2006.01) |

(52) U.S. Cl.

CPC ..... *C25D 3/44* (2013.01); *C25C 3/06* (2013.01); *C25D 3/56* (2013.01); *C25D 3/665* (2013.01); *C25D 5/18* (2013.01)

(58) Field of Classification Search

CPC ..... C25D 3/665
USPC ..... 205/234–237
See application file for complete search history.

(56) References Cited

U.S. PATENT DOCUMENTS

| | | | | |
|---|---|---|---|---|
| 3,977,949 | A | 8/1976 | Rosenberg | |
| 4,003,804 | A * | 1/1977 | Wong | C25D 3/44 205/233 |
| 4,502,926 | A | 3/1985 | Barber, Jr. | |
| 4,888,255 | A * | 12/1989 | Yoshimitsu | H01M 6/14 429/101 |
| 5,200,057 | A | 4/1993 | Canaris | |
| 5,750,017 | A | 5/1998 | Zhang | |
| 5,846,485 | A * | 12/1998 | Leland | G01N 33/569 422/52 |
| 2007/0259452 | A1 * | 11/2007 | Schlenoff | C12Q 1/6825 436/528 |
| 2010/0285322 | A1 | 11/2010 | Inoue et al. | |
| 2011/0083967 | A1 | 4/2011 | Ruan et al. | |
| 2012/0006688 | A1 | 1/2012 | Alemany et al. | |
| 2012/0031766 | A1 | 2/2012 | Inoue et al. | |
| 2012/0052324 | A1 | 3/2012 | Inoue et al. | |
| 2012/0118745 | A1 | 5/2012 | Bao | |

(Continued)

FOREIGN PATENT DOCUMENTS

BE WO 2007147222 A2 * 12/2007 ..... C07C 229/12

OTHER PUBLICATIONS

International Search Report and Written Opinion mailed Aug. 19, 2014 for Application No. PCT/US2014/021947.

(Continued)

*Primary Examiner* — Brian W Cohen
(74) *Attorney, Agent, or Firm* — Wolf, Greenfield & Sacks, P.C.

(57) ABSTRACT

Leveling additives, their use in electrodeposition, and regeneration are described. In one embodiment, an electrodeposition bath may include a non-aqueous liquid and an optionally substituted aromatic hydrocarbon. The optionally substituted aromatic hydrocarbon may be protonated.

15 Claims, 5 Drawing Sheets

(56) References Cited

U.S. PATENT DOCUMENTS

2014/0272458 A1 9/2014 Ruan et al.

OTHER PUBLICATIONS

Mackor et al., The Basicity of Aromatic Hydrocarbons. Part 1—Unsubstituted Polynuclear Compounds. Trans Faraday Soc. 1958;54:66-83.
Mackor et al., The Basicity of Aromatic Hydrocarbons. Part 2—Methyl-Substituted Compounds. Trans Faraday Soc. 1958;54:186-94.
Matsui et al., Fabrication of bulk nanocrystalline Al electrodeposited from a dimethylsulfone bath. Mater Sci Eng A. 2012;550:363-6.
Prasad et al., Control and optimization of baths for electrodeposition of Co—Mo—B amorphous alloys. Brazil J Chem Eng. Dec. 2000;17(4-7):423-32. http://dx.doi.org/10.1590/S0104-66322000000400007. 11 pages.
Ruan et al., Towards electroformed nanostructured aluminum alloys with high strength and ductility. J Mater Res. 2012;27(12):1638-51. 14 pages.
Schuh et al., Electrodeposited Al—Mn alloys with microcrystalline, nanocrystalline, amorphous and nano-quasicrystalline structures. Acta Mater. 2009;57:3810-22.
Schuh et al., Tuning nanoscale grain size distribution in multilayered Al—Mn alloys. Scripta Mater. 2012;66:194-7.
Sharma et al., Effect of various additives on morphological and structural characteristics of pulse electrodeposited tin coatings from stannous sulfate electrolyte. Appl Surf Sci. Sep. 30, 2014;314:516-22. doi: 10.1016/j.apsusc.2014.07.037.
Zavarine et al., Spectroelectrochemical Study of the Effect of Organic Additives on the Electrodeposition of Tin. J Electrochem Soc. 2003;150(4):C202-7.

* cited by examiner

LEVELING ADDITIVES FOR ELECTRODEPOSITION

FIELD

Disclosed embodiments are related to leveling additives for electrodeposition.

BACKGROUND

In order to obtain smooth and dense metallic deposits during electrodeposition, it is a common practice to utilize additives that act as leveling additives. The additives are usually surface active, and adsorb onto areas of the surface with the highest charge density. This leads to the suppression of deposition at high energy sites, while making deposition at lower energy sites more favorable providing a more even deposition across the surface.

SUMMARY

In one embodiment, an electrodeposition bath may include a non-aqueous liquid and an optionally substituted aromatic hydrocarbon.

In another embodiment, a method may include: electrodepositing a material in an electrodeposition bath including a non-aqueous liquid and an optionally substituted aromatic hydrocarbon.

In yet another embodiment, a method for preparing an electrodeposition bath with a leveling additive may include: adding an optionally substituted basic aromatic hydrocarbon to a non-aqueous liquid; and protonating the basic aromatic hydrocarbon in the non-aqueous liquid.

In another embodiment, a method may include: adding protons to an electrodeposition bath including a non-aqueous liquid and an optionally substituted basic aromatic hydrocarbon. The protons may react with the optionally substituted basic aromatic hydrocarbon to form an optionally substituted protonated aromatic hydrocarbon.

In yet another embodiment, a method for reducing the acidity of an electrodeposition bath may include: adding an optionally substituted basic aromatic hydrocarbon to a non-aqueous liquid, wherein the optionally substituted basic aromatic hydrocarbon reacts with one or more protons in the electrodeposition bath to form an optionally substituted protonated aromatic hydrocarbon.

In another embodiment, an electrodeposition system may include an electrodeposition bath with a non-aqueous liquid and an optionally substituted protonated aromatic hydrocarbon. The electrodeposition system may also include an anode at least partially immersed in the electrodeposition bath and a cathode at least partially immersed in the electrodeposition bath.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 1:
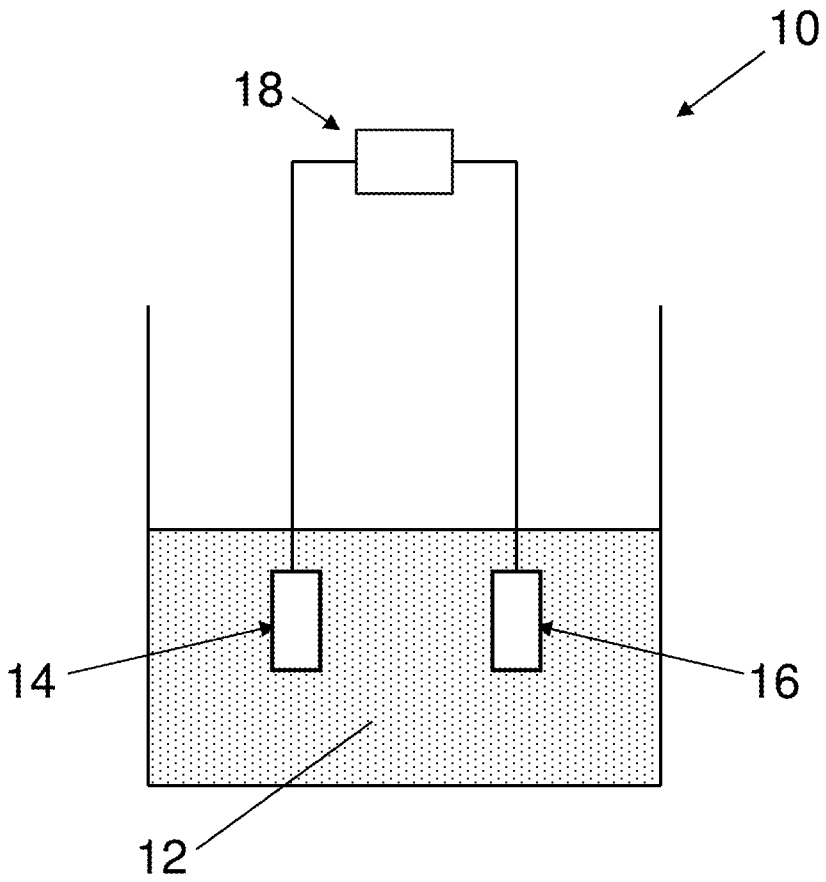
FIG. 1 is a schematic representation of an electrodeposition system.

Many types of coatings may be applied on a base material. Electrodeposition is a common technique for depositing such coatings. Electrodeposition generally involves applying a voltage to a base material placed in an electrodeposition bath to reduce metal ionic species within the bath which deposit on the base material in the form of a metal, or metal alloy, coating. The voltage may be applied between an anode and a cathode using a power supply. The anode or cathode may serve as the base material to be coated. In some electrodeposition processes, the voltage may be applied as a complex waveform such as in pulse deposition, alternating current deposition, or reverse-pulse deposition.

Oftentimes leveling additives are used to obtain smooth dense deposits during electrodeposition by suppressing the formation of dendrites. Without wishing to be bound by theory, leveling additives are usually surface active, and adsorb onto areas of the surface with the highest charge density. While many types of leveling additive functionalities may lead to this behavior, in some instances a leveling additive including a positively charged compound is attracted towards high energy sites on the negatively charged cathode during electrodeposition. By adsorbing onto the high energy sites, the leveling additives may make electrodeposition at the lower energy sites more favorable leading to a more even deposition across the surface.

The inventors have recognized that the lack of effective surface leveling additives for non-aqueous liquids, including ionic liquids, to suppress dendritic growth and enable the formation of smooth dense deposits has hampered the development of high rate deposition methods. Furthermore, given the differences between these non-aqueous electrodeposition baths and previous aqueous based electrodeposition baths, it is not clear that additives and methods used for aqueous based electrolyte baths are capable of working in ionic liquid based electrodeposition systems.

In view of the above, the inventors recognized the benefits associated with aromatic hydrocarbons that are sufficiently basic to be stable proton addition complexes capable of forming a stable protonated species in a non-aqueous liquid and functioning as leveling additives. This is in comparison to the use of aromatic hydrocarbons in aqueous electrodeposition baths where the protonated species are not stable and the non-protonated compounds are only used as surfactants. In some embodiments, the aromatic hydrocarbons described herein may be optionally substituted as described in more detail below. For example, possible substituents include, but are not limited to, alkyls, aryls, and polyalkoxy chains. For the purposes of this application, aromatic hydrocarbons should be understood to include polyaromatic hydrocarbons.

In some embodiments, an aromatic hydrocarbon capable of being protonated in the non-aqueous electrodeposition bath may be a polymer. Suitable polymers include, but are not limited to polystyrenes.

In view of the above, in one embodiment, the inventors have recognized the benefits associated with a leveling additive including a protonated aromatic hydrocarbon used in an electrodeposition bath including a non-aqueous liquid. Without wishing to be bound by theory, the protonated additives are charged cations that are attracted to the negatively charged cathode. Therefore, the protonated additives form a surface active layer which may suppress electrodeposition in regions of high current density thus aiding in obtaining level deposits. During use, the protonated additives may undergo a reduction reaction as described in more detail below. After being reduced, the additives may no longer function as leveling additives. Therefore, in some embodiments, it may be desirable to regenerate the electrodeposition bath by introducing protons, or a source of protons such as an acid, to react with the leveling additives to form the previously noted protonated aromatic hydrocarbons.

For the purposes of this application, the terms "protonation", "protonated molecule", "reactions with protons", and similar phrases refer to a molecule that has reacted with a proton ($H^+$) to form a positive cation. It should be understood, that a proton may correspond to any positive hydrogen isotope including, but not limited to, $^1H^+$, $^2H^+$, and $^3H^+$.

It should be understood that the protonated aromatic hydrocarbons may be provided in any number of ways. For example, in one embodiment, a protonated aromatic hydrocarbon may be formed prior to introduction into an electrodeposition bath. Alternatively, in another embodiment, a basic aromatic hydrocarbon may be added to an electrodeposition bath including a non-aqueous liquid where it reacts with protons already in, or that may be added to, the electrodeposition bath to form the protonated compounds. Similarly, previously protonated additives that have been reduced may be regenerated by reacting with protons either already in, or that may be added to, an electrodeposition bath to form the protonated compounds. Without wishing to be bound by theory, it is not well understood whether or not the protons are completely disassociated within the non-aqueous electrodeposition bath. For example, in a chloroaluminate ionic liquid the chloride cation may be partially bound to both an aluminum anion and/or a proton from a partially disassociated acid such as HCl. However, in either case, once a sufficiently basic aromatic hydrocarbon is introduced, it may react with the proton to become a protonated aromatic hydrocarbon.

Without wishing to be bound by theory, a measure of the basicity of an aromatic hydrocarbon may be given by the basicity constant, K, more generally given as log(K). The range of log(K) for aromatic hydrocarbons typically varies from −9.4 to 6.5. A more negative value of log(K) is less basic, and a more positive value of log(K) is more basic. Aromatic hydrocarbons with strong negative values are thus more difficult to protonate. However, compounds with large positive log(K) values may be too reactive for use as a leveling additive. Therefore, in some embodiments the log (K) value of an aromatic hydrocarbon for use as a leveling additive in a non-aqueous electrodeposition bath may be between or equal to −3 to 5, −1 to 3, or any other appropriate range both greater than and less than those noted above.

In embodiments where it is desirable to add protons to an electrodeposition bath to either initially prepare or regenerate a leveling additive, the protons may be added in any number of ways. In one embodiment, an acid may be added to the electrodeposition bath to provide the protons. The acid may be added to the electrodeposition bath by bubbling a dry gaseous acid through the electrodeposition bath, adding a more acidic non-aqueous liquid to the electrodeposition bath, and/or any other appropriate method. In such an embodiment, the acid may be a strong acid such as hydrogen chloride, hydrogen bromide, hydrogen iodide, and other appropriate acids that disassociate to form acidic protons in the electrodeposition bath.

In another embodiment, materials may be added to an electrodeposition bath that react with the electrodeposition bath to form an acid to provide the desired protons. For example, compounds including hydroxyl (—OH) groups may be added to the electrodeposition bath to form an acid. In one embodiment, water and/or hydrates, such as aluminum chloride hydrate, may be added to the electrodeposition bath. In some embodiments, the hydrate may include elements that are already present within the electrodeposition bath. In another embodiment, alumina, silica, and/or other materials including surface hydroxyl groups capable of reacting with the electrodeposition bath to form an acid, and that are compatible with an electrodeposition process, may be added to an electrodeposition bath to form an acid and provide the desired protons. The materials including surface hydroxyl groups may be provided in any desirable form including, but not limited to, particles, flakes, foams, and/or any other appropriate form. Without wishing to be bound by theory, the surface area to volume ratio increases with decreasing particle size. Therefore, smaller size scale materials may exhibit more surface hydroxyl groups relative to their volume than larger size scale materials. While any appropriate size material may be used, in some embodiments, a material including surface hydroxyl groups may have a size that is between or equal to about 10 μm and 200 μm, though sizes both less than and greater than that noted above are contemplated. In yet another embodiment, compounds including hydroxyl groups, such as cellulose, may be added to the electrodeposition bath to undergo a reaction to form the desired acid. Again, compounds including a hydroxyl group may be provided in any form and size including particles, foams, and/or flakes.

Depending on the electrodeposition process, protons may be added to the electrodeposition bath either continuously, or in batches, as the disclosure is not so limited. For example, a dry gaseous acid may be bubbled continuously through the electrodeposition bath at a predetermined rate, or the dry gaseous acid may be bubbled through the electrodeposition bath at predetermined intervals to maintain a desired acidity of the electrodeposition bath. While a single example is given above, it should be understood that any appropriate method for introducing protons into, or forming protons in, an electrodeposition bath may be used either continuously or at predetermined intervals to maintain the desired acidity of the electrodeposition bath.

Without wishing to be bound by theory, as described herein, ionic liquids, such as chloraluminate ionic liquids, are Lewis acids due to the presence of Lewis acidic (electron accepting) species such as Lewis acidic aluminum species. Additionally, the protons ($H^+$) present in the electrodeposition bath are Brönsted acids (proton donation). Similarly, the aromatic hydrocarbons that accept the protons are Brönsted bases (proton accepting).

In some instances it may be desirable to reduce the acidity (i.e. decrease the $H^+$ concentration) of a non-aqueous electrodeposition bath. For example, a particular leveling additive being used in an electrodeposition process may not function appropriately if the electrodeposition bath becomes too acidic. In such an embodiment, a sufficiently basic non-protonated aromatic hydrocarbon may be added to the electrodeposition bath to react with the protons ($H^+$) and form protonated aromatic hydrocarbons. This reaction with the protons in the non-aqueous electrodeposition bath may reduce the acidity of the bath. In some embodiments, the now protonated aromatic hydrocarbons may also provide an additional function as leveling additives in the electrodeposition bath as noted above.

Examples of appropriate aromatic hydrocarbons which are useful as protonated leveling additives include 4-tertbutyltoluene, 4-isopropyltoluene, 1,4-diisopropylbenzene, mesitylene, 1,2,4,5-tetramethylbenzene, 1,2,3-tetramethylbenzene, pentamethylbenzene, hexamethylbenzene, tertbutylbenzene, 1,3,5-tritertbutylbenzene, 3,5-ditertbutyltoluene, benzethonium chloride, anthracene, 9,10-dimethylanthracene, 2-methylanthracene, 9-ethylanthracene, 1,2-benzanthracene, acenapthene, naphthacene, pyrene, 3,4-benzopyrene, perylene, polystyrene, 4-tertbutylpolystyrene, and polyethoxylated alkyl phenols (Trade names: Triton X-100, IGEPAL CA-210, IGEPAL CO-520, IGEPAL CO-890, IGEPAL DM-970 and others). While specific aromatic hydrocarbons are noted above, it should be understood that the current disclosure is not limited to only these compounds. Instead, the current disclosure should be read generally as applying to any appropriate aromatic hydrocarbon that is sufficiently basic to be capable of forming a protonated species that functions as a leveling additive in a non-aqueous electrodeposition bath.

Several general structures that may form protonated aromatic hydrocarbons include, but are not limited to, the following structures.

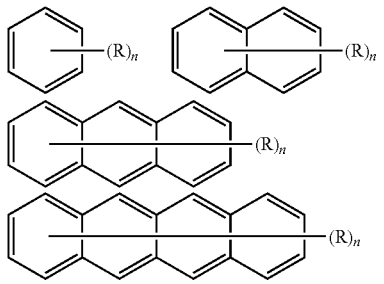

In the above noted structures, the each incidence of a substituent R is independently selected from alkyls, aryls, and polyalkoxy chains. Additionally, the number of substituents n can range from 0 to (2z+4) where z is the number of rings, or any other appropriate number of substituents. Additionally, depending on the embodiment, the number of rings may be 1, 2, 3, 4, or any appropriate number of rings as the disclosure is not so limited.

It should be understood that the desired concentration of an aromatic hydrocarbon within a particular non-aqueous electrodeposition bath may depend on the particular non-aqueous liquids present within the bath, the types of materials being deposited, the deposition currents and voltages, and other considerations. Therefore, the use of the leveling additives described herein should not be limited to any particular concentration range. However, in some embodiments, a leveling additive may have a concentration greater than about 0.5 wt. %, 1 wt. %, 2 wt. %, 3 wt. %, 4 wt. %, or 5 wt. %. Similarly, the leveling additive may have a concentration less than about 10 wt. %, 9 wt. %, 8 wt. %, 7 wt. %, 6 wt. %, or 5 wt. %. Combinations of the above ranges are possible. For example, the leveling additives described herein may be present in the electrodeposition bath in a concentration between about 0.5 wt. % to 10 wt. %. The above noted weight percentages are given relative to the non-aqueous liquid, which in some embodiments is an ionic liquid, present in the electrodeposition bath. Additionally, concentrations both greater than and less than those noted above are also contemplated.

As noted above, the leveling additives may be deprotonated through a reduction reaction during electrodeposition. However, the leveling additives may also be reprotonated by reacting with acidic protons in the electrodeposition bath. The percentage of leveling additive in the protonated state will be dependent on the reduction rate and reprotonation rate of the leveling additive. In view of the above, in some embodiments, it may be desirable to maintain a sufficient electrodeposition bath acidity, i.e. acidic proton concentration, to maintain a particular amount of the leveling additive in protonated form. The particular concentrations necessary to maintain a desired amount of the leveling additive in its protonated state will vary depending on the particular leveling additive being used, the rate at which the leveling additive deprotonates, as well as various electrodeposition operating parameters. However, in some embodiments, the proton concentration is selected such that at least a majority of the leveling additive, i.e. more than 50%, is maintained in its protonated state. For example, in one embodiment, the proton concentration is selected such that the percentage of leveling additive in the protonated state is between about 70% and 99%. In other embodiments, the percentage of the leveling additive in the protonated state may be greater than about 70%, 80%, or 90%. Similarly, the percentage of the leveling additives in the protonated state may be less than about 99%, 90%, or 80%. Combinations of the above ranges are envisioned. While particular percentages of the leveling additive in the protonated state are provided above, percentages both greater than and less than those noted above are contemplated.

The protonated aromatic hydrocarbons used as leveling additives may be used at any appropriate temperature. For example, the leveling additives may be used between the electrodeposition bath melting temperature and a temperature corresponding to the stability limit of the leveling additive. For example, a leveling additive might be used at temperatures that are greater than about 10° C., 20° C., 50° C., 100° C., or any other appropriate temperature. In one particular embodiment, the operating temperature is less than about 150° C. corresponding to the stability limit of the carbon ring in the aromatic hydrocarbon. In such an embodiment, the electrodeposition bath might be operated at temperatures between about 10° C. and 150° C. While particular temperatures are given above, it should be understood that other temperatures both greater than and less than those noted above are also contemplated.

It should be appreciated that the aromatic compounds, as described herein, may be substituted with any number of substituents which confer suitable properties (i.e. basicity) to permit the additive to exist in a protonated form in a non-aqueous electrodeposition bath. That is, any of the above noted groups may be optionally substituted. As used herein, the term "substituted" is contemplated to include all permissible substituents of organic compounds, "permissible" being in the context of the chemical rules of valence known to those of ordinary skill in the art. In general, the term "substituted" whether preceded by the term "optionally" or not, and substituents contained in formulas of this disclosure, refer to the replacement of hydrogen radicals in a given structure with the radical of a specified substituent. When more than one position in any given structure may be substituted with more than one substituent selected from a specified group, the substituent may be either the same or different at every position. It will be understood that "substituted" also includes that the substitution results in a stable compound, e.g., which does not spontaneously undergo transformation such as by rearrangement, cyclization, elimination, etc. In some cases, "substituted" may generally refer to replacement of a hydrogen with a substituent as described herein. However, "substituted," as used herein, does not encompass replacement and/or alteration of a key functional group by which a molecule is identified, e.g., such that the "substituted" functional group becomes, through substitution, a different functional group. In a broad aspect, the permissible substituents include acyclic and cyclic, branched and unbranched, carbocyclic and heterocyclic, aromatic and nonaromatic substituents of organic compounds. Illustrative substituents for the aromatic hydrocarbons described herein include, but are not limited to: alkyls, aryls, and polyalkoxy chains. For purposes of this disclosure, the heteroatoms such as nitrogen may have hydrogen substituents and/or any permissible substituents of organic compounds described herein which satisfy the valencies of the heteroatoms. Furthermore, this disclosure is not intended to be limited in any manner by the permissible substituents of organic compounds.

As used herein, "aromatic hydrocarbon" refers to monocyclic or polycyclic (e.g., bicyclic, tricyclic, etc. . . . ) unsaturated hydrocarbon having from 6 to 18 carbon atoms ("$C_{6-18}$ aromatic hydrocarbon"), 6 to 22 carbon atoms ("$C_{6-22}$ aromatic hydrocarbon"), or any other appropriate number of carbon atoms. Unless otherwise specified, each instance of an aromatic hydrocarbon is independently unsubstituted (an "unsubstituted aromatic hydrocarbon") or substituted (a "substituted aromatic hydrocarbon") with one or more substituents. In certain embodiments, the aromatic hydrocarbon is an unsubstituted $C_{6-18}$ aromatic hydrocarbon. In certain embodiments, the aromatic hydrocarbon is a substituted $C_{6-18}$ aromatic hydrocarbon. In some embodiments, the aromatic hydrocarbon is a substituted or unsubstituted $C_{6-22}$ aromatic hydrocarbon.

As used herein, "alkyl" refers to a radical of a straight-chain or branched saturated hydrocarbon group having from 1 to 18 carbon atoms ("$C_{1-18}$ alkyl"). In some embodiments, an alkyl group has 1 to 9 carbon atoms ("$C_{1-9}$ alkyl"). Unless otherwise specified, each instance of an alkyl group is independently unsubstituted (an "unsubstituted alkyl") or substituted (a "substituted alkyl") with one or more substituents. In certain embodiments, the alkyl group is an unsubstituted $C_{1-18}$ alkyl (e.g., —$CH_3$). In certain embodiments, the alkyl group is a substituted $C_{1-18}$ alkyl. In some embodiments, the alkyl group is a substituted or unsubstituted $C_{12-16}$ alkyl group. Without wishing to be bound by theory, a longer tail may help to provide a bifunctional molecule capable of orienting a hydrophobic tail group away from the negatively charged cathode during electrodeposition. However, any of the above alkyl groups may still be used.

As used herein, "aryl" refers to a radical of a monocyclic or polycyclic (e.g., bicyclic, tricyclic, etc. . . . ) 4n+2 aromatic ring system (e.g., having 6, 10, or 14 π electrons shared in a cyclic array) having 6-14 ring carbon atoms and zero heteroatoms provided in the aromatic ring system ("$C_{6-14}$ aryl"). "Aryl" also includes ring systems wherein the aryl ring is fused with one or more carbocyclyl or heterocyclyl groups wherein the radical or point of attachment is on the aryl ring, and in such instances, the number of carbon atoms continue to designate the number of carbon atoms in the aryl ring system. Unless otherwise specified, each instance of an aryl group is independently unsubstituted (an "unsubstituted aryl") or substituted (a "substituted aryl") with one or more substituents. In certain embodiments, the aryl group is an unsubstituted $C_{6-14}$ aryl. In certain embodiments, the aryl group is a substituted $C_{6-14}$ aryl.

As used herein, a "polyalkoxy chain" refers to a substituent group including 1 to 40 repeating units of an alkyl group bonded to an oxygen atom. For example, a polyalkoxy chain might include a polymethoxy chain including ($CH_3O$—) units or a polyethoxy chain including ($CH_2CH_2O$—) units. In some embodiments, a polyalkoxy chain terminates in an —OH group. However, embodiments in which a polyalkoxy chain terminates in an alkyl, aryl, substituted phenol, or quaternary ammonium group instead of an —OH group are also contemplated. While any length polyalkoxy chain may be used, in some embodiments, the polyalkoxy chain includes between or equal to 5 and 10 repeating units. Without wishing to be bound by theory, polyalkoxy chains with these lengths may be more readily dissolved within a nonaqueous electrodeposition bath. Unless otherwise specified, each instance of a polyalkoxy chain is independently unsubstituted (an "unsubstituted polyalkoxy chain") or substituted (a "substituted polyalkoxy chain") with one or more substituents.

The above noted leveling additives and methods may be used with any appropriate non-aqueous electrodeposition bath. However, in one embodiment, the electrodeposition bath includes an ionic liquid with one or more metal ionic species. The electrodeposition bath may also include one or more appropriate co-solvents. Appropriate ionic liquid, metal ionic species, and co-solvents are described in more detail below. The metal ionic species present in the bath may be selected for depositing pure metals or alloys as the disclosure is not so limited.

Non-limiting examples of types of metal ionic species include Sc, Ti, V, Cr, Mn, Fe, Co, Ni, Cu, Y, Zr, Nb, Mo, Tc, Rh, Ru, Ag, Cd, Pt, Pd, Ir, Hf, Ta, W, Re, Os, Li, Na, K, Mg, Be, Ca, Sr, Ba, Ra, Zn, Au, U, Al, Si, Ga, Ge, In, Tl, Sn, Sb, Pb, Bi, and Hg. In one specific embodiment, the metal ionic species include at least aluminum or aluminum and manganese for depositing pure aluminum and an aluminum manganese alloy respectively. The metal ionic species may be provided in any suitable amount relative to the total bath composition. Additionally, the metal ionic species may be provided in any appropriate form. For example, aluminum might be provided in the form of an aluminum chloride ($AlCl_3$) added to the electrodeposition bath.

Those of ordinary skill in the art will be aware of suitable ionic liquids to use in connection with the electrodeposition baths and methods described herein. The term "ionic liquid" as used herein is given its ordinary meaning in the art and refers to a salt in the liquid state. In embodiments wherein an electrodeposition bath comprises an ionic liquid, this is sometimes referred to as an ionic liquid electrolyte. The ionic liquid electrolyte may optionally comprise other liquid components, for example, a co-solvent, as described herein.

An ionic liquid generally comprises at least one cation and at least one anion. In some embodiments, the ionic liquid comprises an imidazolium, pyridinium, pyridazinium, pyrazinium, oxazolium, triazolium, pyrazolium, pyrrolidinium, piperidinium, tetraalkylammonium or tetraalkylphosphonium salt. In some embodiments, the cation is an imidazolium, a pyridinium, a pyridazinium, a pyrazinium, a oxazolium, a triazolium, or a pyrazolium. In some embodiments, the ionic liquid comprises an imidazolium cation. In some embodiments, the anion is a halide. In some embodiments, the ionic liquid comprises a halide anion and/or a tetrahaloaluminate anion. In some embodiments, the ionic liquid comprises a chloride anion and/or a tetrachloroaluminate anion. In some embodiments, the ionic liquid comprises tetrachloroaluminate or bis(trifluoromethylsulfonyl) imide. In some embodiments, the ionic liquid comprises butylpyridinium, 1-ethyl-3-methylimidazolium [EMIM], 1-butyl-3-methylimidazolium [BMIM], benzyltrimethylammonium, 1-butyl-1-methylpyrrolidinium, 1-ethyl-3-methylimidazolium, or trihexyltetradecylphosphonium. In some embodiments, the ionic liquid comprises 1-ethyl-3-methylimidazolium chloride. In one specific embodiment a chloroaluminate ionic liquid such as [EMIM]Cl/$AlCl_3$ and/or [BMIM]Cl/$AlCl_3$ may be used in the electrodeposition bath.

In some embodiments, the co-solvent is an organic solvent which may, or may not be, an aromatic solvent. In some embodiments, the co-solvent is selected from the group consisting of toluene, benzene, tetralin (or substituted versions thereof), ortho-xylene, meta-xylene, para-xylene, mesitylene, halogenated benzenes including chlorobenzene and dichlorobenzene, and methylene chloride. In some embodiments, the co-solvent is toluene. The co-solvent may be present in any suitable amount. In some embodiments, the co-solvent is present in an amount between about 1 vol % and 99 vol %, between about 10 vol % and about 90 vol %, between about 20 vol % and about 80 vol %, between about 30 vol % and about 70 vol %, between about 40 vol % and about 60 vol %, between about 45 vol % and about 55 vol %, or about 50 vol % versus the total bath composition. In some embodiments, the co-solvent is present in an amount greater than about 50 vol %, 55 vol %, 60 vol %, 65 vol %, 70 vol %, 80 vol %, or 90 vol % versus the total bath composition. In some embodiments, the co-solvent and the ionic liquid form a homogenous solution.

The specific co-solvent to be used may be selected based upon any number of desired characteristics including, for example, viscosity, conductivity, boiling point, and other characteristics as would be apparent to one of ordinary skill in the art.

One or more co-solvents may be mixed with the ionic liquid in any desired ratio to provide the desired electrodeposition bath properties. For example, in some embodiments, the co-solvent may also be selected based on its boiling point. In some cases, a higher boiling point co-solvent may be employed as it can reduce the amount and/or rate of evaporation from the electrolyte, and thus, may aid in stabilizing the process. Those of ordinary skill in the art will be aware of the boiling points of the co-solvents described herein (e.g., toluene, 111° C.; methylene chloride, 41° C.; 1,2-dichlorobenzene, 181° C.; o-xylene, 144° C.; and mesitylene, 165° C.). While specific co-solvents and their boiling points are listed above, other co-solvents are also possible. Furthermore, in some embodiments the co-solvent is selected based upon multiple criteria including, but not limited to, conductivity, boiling point, and viscosity of the resulting electrodeposition bath.

Turning now to the figures, several non-limiting embodiments of leveling additives, their methods of use, and methods for regenerating an electrodeposition bath are discussed in more detail.

FIG. 1 shows an electrodeposition system 10 according to an embodiment. System 10 includes a electrodeposition bath 12. An anode 14 and cathode 16 are provided in the bath. The bath may include metal sources either in the form of metal ionic species added directly to the bath and/or the anode itself may be used as a source for the metal ionic species present in the bath that are used for electrodepositing a metal layer on the cathode. The bath may also include one or more additives and/or co-solvents as described herein. A power supply 18 is connected to the anode and the cathode. During use, the power supply generates a waveform which creates a voltage difference between the anode and cathode. The voltage difference leads to reduction of metal ionic species in the bath which deposit in the form of a coating on the cathode, in this embodiment, which may also function as the deposition substrate in some embodiments. It should be understood that the illustrated system is not intended to be limiting and may include a variety of modifications as known to those of skill in the art.

Figure 2:
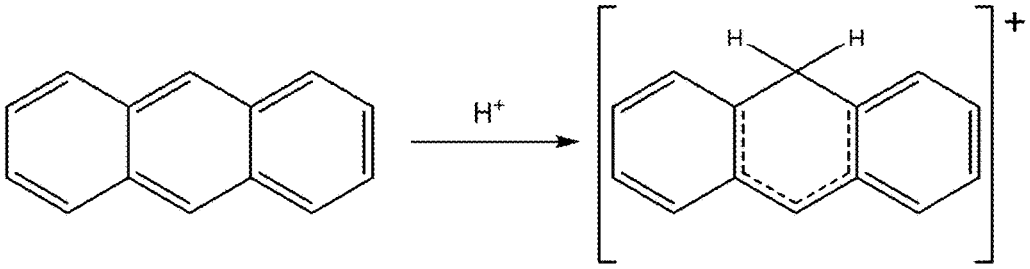
FIG. 2 is a schematic representation of anthracene ($C_{14}H_{10}$) undergoing a reaction with a proton ($H^+$) to form protonated anthracene $(C_{14}H_{11})^+$.
Figure 3:
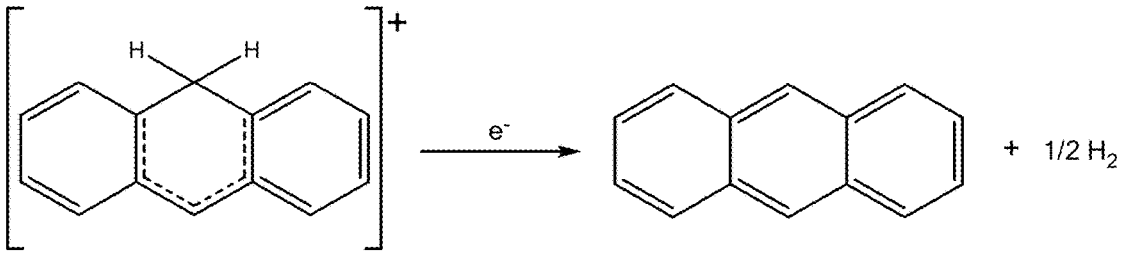
FIG. 3 is a schematic representation of protonated anthracene $(C_{14}H_{11})^+$ being reduced to form anthracene ($C_{14}H_{10}$) and a proton ($H^+$)

Without wishing to be bound by theory, the proposed basic aromatic hydrocarbons function as proton-addition complexes within a non-aqueous electrodeposition bath, such as a chloroaluminate ionic liquid bath. For example, FIG. 2 depicts a protonation reaction of anthracene ($C_{14}H_{10}$) with a proton ($H^+$) located within the electrodeposition bath. In the depicted embodiment, the compound accepts the positively charged proton to form a protonated anthracene $(C_{14}H_{11})^+$. The now protonated aromatic hydrocarbon is a charged cation that may interact strongly with the negatively charged cathode during the electrodeposition process. The leveling additive consequently forms a surface active layer on the deposition surface which suppresses electrodeposition in regions of high current density which may result in more level deposits. However, and without wishing to be bound by theory, during electrodeposition, part or all of the protonated aromatic hydrocarbons may themselves be electrochemically reduced. Such a reaction is shown in FIG. 3 where a protonated arene ring of the protonated anthracene $(C_{14}H_{11})^+$ loses a proton by reacting with an electron ($e^-$) to form anthracene ($C_{14}H_{10}$) and hydrogen gas ($H_2$).

Once a leveling additive has been deprotonated, the additive is no longer a positively charged cation. Therefore, the additive may not be attracted towards the cathode and thus would not behave as a leveling additive. However, the additive may be protonated again by a chemical reaction with protons ($H^+$), which may be introduced into the electrodeposition bath in any number of ways. Since reduction of the protonated leveling additive may occur continuously during electrodeposition, the introduction of acid into the bath may either be carried out continuously or in batches as the disclosure is not so limited.

In one embodiment, a dry gaseous acid, such as HCl, may be bubbled through the electrodeposition bath to introduce protons without introducing additional water to the non-aqueous electrodeposition bath.

In another embodiment, the electrodeposition bath may be replenished by carrying out a controlled hydrolysis of compounds including hydroxyl (—OH) groups added to the electrodeposition bath to produce an acid, such as HCl. Compounds containing hydroxyl groups may be added to the electrodeposition bath in a number of ways including, but not limited to, the measured addition of $H_2O$ to the electrodeposition bath, as a liquid, or as a solid hydrate.

While any appropriate hydrate may be used, in some instances, the hydrate may be selected to correspond with the electrodeposition bath chemistry. For example, $AlCl_3.6H_2O$ might be used for an electrodeposition bath including a chloroaluminate ionic liquid. Similarly, alumina, silica, and/or other materials compatible with the electrodeposition bath that include surface hydroxyl groups capable of reacting to form an acid, such as HCl, may be added to the electrodeposition bath. These materials may be provided in any appropriate form including, but not limited to, powders, particles, foams, flakes, and/or any other appropriate form as the disclosure is not so limited. After reacting with the electrodeposition bath, in some embodiments, the remaining material may be filtered out of the electrodeposition bath using any appropriate method. An example of an alumina powder including a surface hydroxyl group reacting with a chloroaluminate ionic liquid to form HCl is provided below. While a particular reaction is shown below, it should be understood that any number of reactions capable of forming different acids in the electrodeposition bath might be used.

$$Al_2O_3—OH_{[surf]}+Al_xCl_y \rightarrow Al_2O_3—O—Al_xCl_{(y-1)[surf]}+HCl$$

In another embodiment, protons are added to the electrodeposition bath through a chemical reaction of a compound including a hydroxyl group with a component of the electrodeposition bath. In one specific embodiment, cellulose, which may be in the form of cellulose powder or any other appropriate form, is added to a non-aqueous electrodeposition bath to form an acid therein. In instances where the electrodeposition bath includes a chloroaluminate ionic liquid, HCl is formed in the electrodeposition bath according to the reaction provided below.

$$[C_6H_7O_2(OH)_3]_n+3(n)Al_xCl_y \rightarrow [C_6H_7O_2(OAl_xCl_{(y-1)})_3]_n+3(n)HCl$$

U.S. patent application Ser. No. 13/830,521, filed on Mar. 14, 2013, entitled "Electrodeposition in Ionic Liquid Electrolytes," is incorporated by reference in its entirety for all purposes including electrodeposition bath chemistries, electrodeposition systems, and electrodeposition methods. In instances where the disclosure of the current application and a reference incorporated by reference conflicts, the current disclosure controls.

Figure 4:
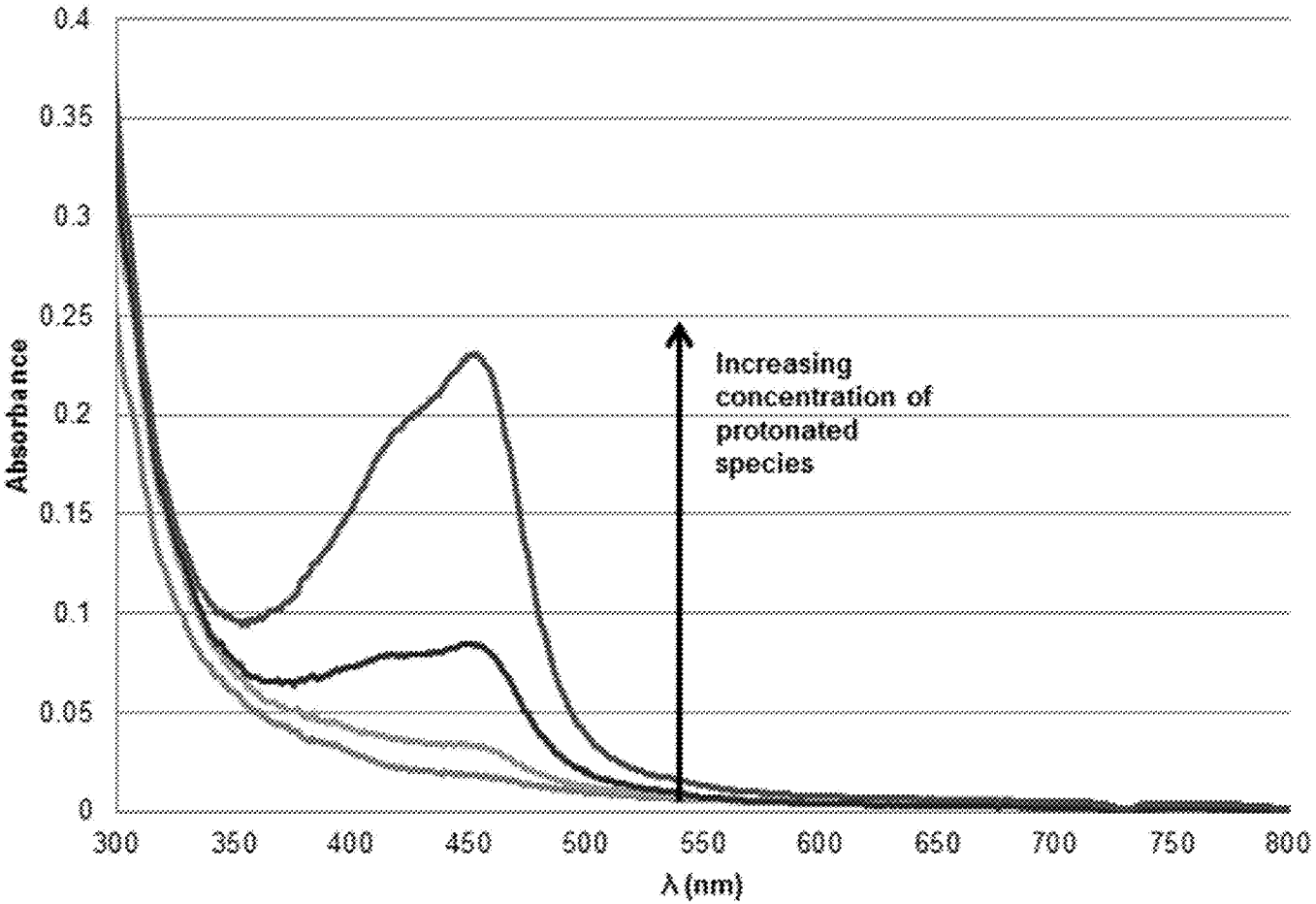
FIG. 4 is a graph of ultraviolet/visible absorption spectra for increasing concentrations of protonated leveling additive in an electrodeposition bath.

Depending on the particular compound being protonated, an electrodeposition bath may change colors according to the amount of protonated leveling additive present in the bath. For example, some protonated leveling additives may exhibit a yellow or red color. Therefore, in some embodiments, an intensity of the coloration, or conversely the amount of absorption, at a particular wavelength may be used to determine the amount of protonated leveling additive in a bath which may then be used to adjust and/or control the regeneration rate of the bath. FIG. 4 presents an overlay of several ultraviolet/visible spectra that exhibit increasing absorption at a wavelength of about 460 nm for an electrodeposition bath including increasing concentrations of protonated 4-tertbutyltoluene species in an ionic liquid/toluene bath.

Example

Batch Electrodeposition Bath Regeneration

A 40 ml bath containing $[EMIM].Al_2Cl_7$ ionic liquid, 0.4 wt. % $MnCl_2$, 50 vol. % toluene as a co-solvent, and 2 wt. % 4-tertbutyltoluene as a leveling additive, was used to plate aluminum-manganese alloy on a copper substrate. The above noted weight percentages are given relative to the ionic liquid weight. The initial HCl concentration of the ionic liquid was sufficient to protonate about 75-100% of the tert-butyltoluene present in the bath, as confirmed by separate experiments. The electrodeposition was carried out using a reverse pulse technique. The electrodeposited samples were 40 μm thick. The appearance of the samples served as an indicator of the additive activity.

In this example, the electrodeposition bath was regenerated after every 10 Ah/L by adding about 0.175 mMol of HCl to the electrodeposition bath. This amount was selected to be enough to protonate about 10% of the tert-butyltoluene present within the electrodeposition bath.

Figure 5A:
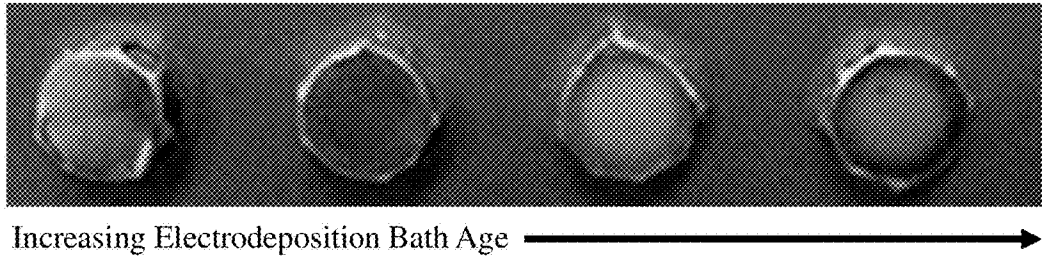
FIGS. 5A-5C depict electrodeposited an aluminum manganese alloy on copper samples where the electrodeposition bath was regenerated between electrodeposition cycles.

Initially, 4-tertbutyltoluene was considered to be protonated by the HCl initially present in the ionic liquid. As shown in FIG. 5A, the electrodeposited alloy initially formed a smooth shiny surface during the initial plating. As the plating continued, the additive slowly deprotonated, and the samples become more matte in appearance as shown for the samples corresponding to electrodeposition from aged electrodeposition baths containing reduced levels of the protonated additive, see FIG. 5A.

Figure 5B:
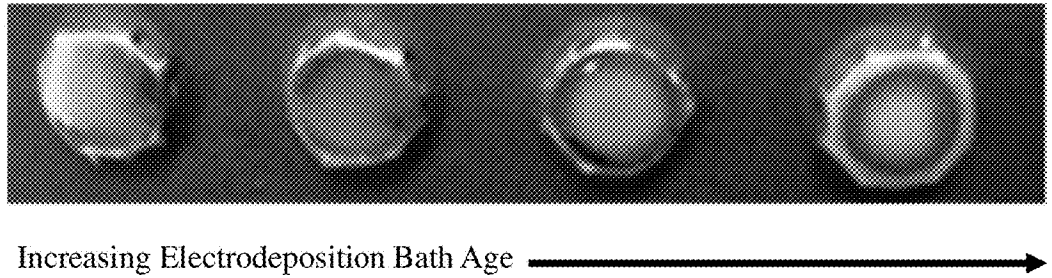
Figure 5C:
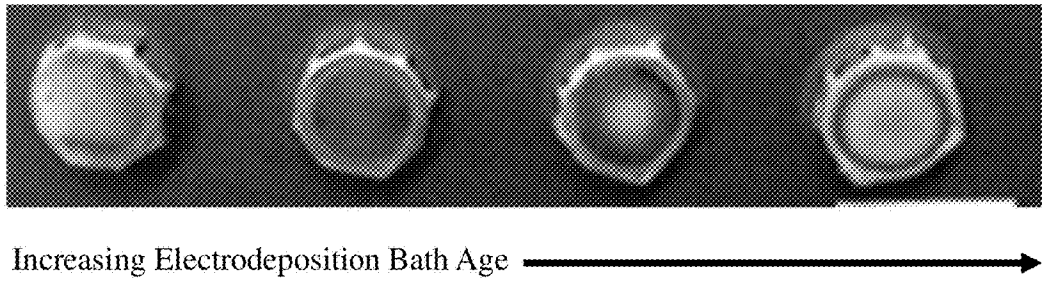

After 10 Ah/l, the additive was regenerated with the indicated amount of HCl. For regeneration, a part of the bath solution was brought into contact with a silica gel powder, which reacted with the ionic liquid to form HCl. The silica was then filtered out, and the solution was mixed back into the bath. The plating was then continued for another 10 Ah/l, then the bath was regenerated again. FIG. 5B shows the electrodeposited samples with increasing electrodeposition bath age after the first bath regeneration. Similar to the initial electrodeposition, the electrodeposited alloy initially formed a smooth shiny surface during the initial deposition which proceeded to a more matte appearance with increasing time indicating deprotonation of the additive. The process was repeated for a third time and similar results were obtained, see FIG. 5C.

In view of the successful regeneration of the electrodeposition bath using HCl, it is possible to restore the activity of the leveling additive by reprotonating the leveling additive already present within the bath without the need to add any additional leveling additive.

Example

Continuous Electrodeposition Bath Regeneration

Figure 6:
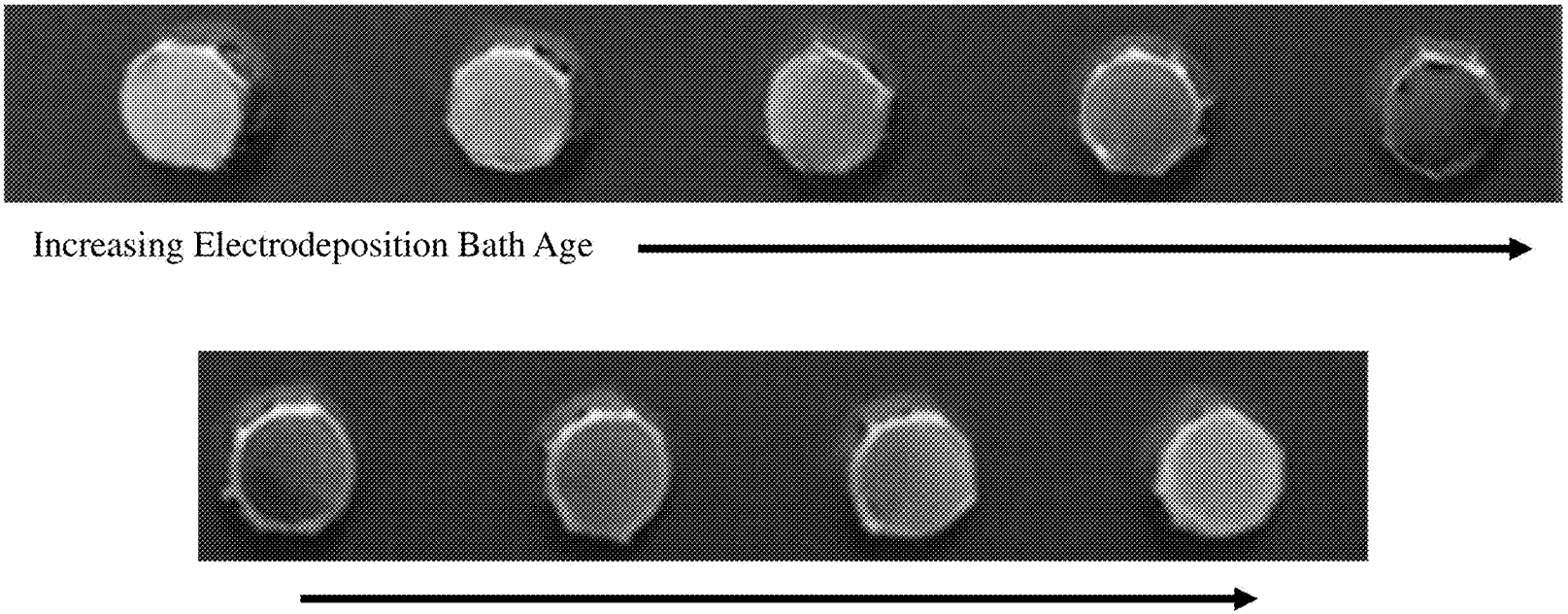
FIG. 6 depicts electrodeposited an aluminum manganese alloy on copper samples where the electrodeposition bath was regenerated continuously during electrodeposition.

An electrodeposition bath and plating process similar to that described above was prepared. However, in this example, the bath regeneration was carried out continuously by adding smaller amounts of HCl to the bath during electrodeposition. The same methods for adding the HCl to the bath as used in the prior example were employed in this example as well. The resulting samples versus increasing electrodeposition bath age for the first 20 Ah/l are shown in FIG. 6. As shown in the figure, the appearance of the samples did not noticeably change during this experiment, although the amount of HCl added to the electrodeposition bath per Ah/l was equivalent to that added in the prior example. Therefore, continuous regeneration of the leveling additive is a viable method for maintaining the electrodeposition bath.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

What is claimed is:

1. An electrodeposition bath comprising:

a non-aqueous liquid, wherein the non-aqueous liquid is an ionic liquid; and an optionally substituted aromatic hydrocarbon, wherein the optionally substituted aromatic hydrocarbon is protonated.

2. The electrodeposition bath of claim 1, wherein the optionally substituted aromatic hydrocarbon includes at least one of 4-tertbutyltoluene, 4-isopropyltoluene, 1,4-diisopropylbenzene, mesitylene, 1,2,4,5-tetramethylbenzene, 1,2,3,5-tetramethylbenzene, pentamethylbenzene, hexamethylbenzene, tertbutylbenzene, 1,3,5-tritertbutylbenzene, 3,5-ditertbutyltoluene, benzethonium chloride, anthracene, 9,10-dimethylanthracene, 2-methylanthracene, 9-ethylanthracene, 1,2-benzanthracene, acenaphthene, naphthacene, pyrene, 3,4-benzopyrene, perylene, polystyrene, 4-tertbutylpolystyrene, and polyethoxylated alkyl phenols.

3. The electrodeposition bath of claim 1, wherein the optionally substituted aromatic hydrocarbon has a concentration in the electrodeposition bath between or equal to about 0.5 weight percent and 10 weight percent relative to the non-aqueous liquid.

4. The electrodeposition bath of claim 1, wherein a substituent of the optionally substituted aromatic hydrocarbon includes at least one of an alkyl, aryl, and polyalkoxy chain.

5. A method comprising:

electrodepositing a material in an electrodeposition bath, wherein the electrodeposition bath includes a non-aqueous liquid and an optionally substituted aromatic hydrocarbon, and wherein the non-aqueous liquid is an ionic liquid and the optionally substituted aromatic hydrocarbon is protonated.

6. The method of claim 5, wherein the optionally substituted aromatic hydrocarbon has a concentration in the electrodeposition bath between or equal to about 0.5 weight percent and 10 weight percent relative to the non-aqueous liquid.

7. A method for preparing an electrodeposition bath with a leveling additive, the method comprising:

adding an optionally substituted aromatic hydrocarbon to a non-aqueous liquid, wherein the non-aqueous liquid is an ionic liquid; and protonating the optionally substituted aromatic hydrocarbon in the non-aqueous liquid.

8. The method of claim 7, wherein the optionally substituted basic aromatic hydrocarbon has a concentration in the electrodeposition bath between or equal to about 0.5 weight percent and 10 weight percent relative to the non-aqueous liquid.

9. A method comprising:

adding protons to an electrodeposition bath including a non-aqueous liquid and an optionally substituted aromatic hydrocarbon, wherein the non-aqueous liquid is an ionic liquid, and wherein the protons react with the optionally substituted aromatic hydrocarbon to form an optionally substituted protonated aromatic hydrocarbon.

10. The method of claim 9, wherein adding protons to the electrodeposition bath includes adding an acid to the electrodeposition bath.

11. The method of claim 10, wherein the acid includes at least one of hydrogen chloride, hydrogen bromide, and hydrogen iodide.

12. The method of claim 11, wherein adding protons to the electrodeposition bath includes further adding hydroxyl groups to the bath.

13. The method of claim 12, wherein adding hydroxyl groups to the bath includes adding at least one of water, a hydrate, alumina, silica, and cellulose.

14. A method for reducing the acidity of an electrodeposition bath, the method comprising:

adding an optionally substituted aromatic hydrocarbon to a non-aqueous liquid, wherein the non-aqueous liquid is an ionic liquid, and, wherein the optionally substituted aromatic hydrocarbon reacts with one or more protons in the electrodeposition bath to form an optionally substituted protonated aromatic hydrocarbon.

15. An electrodeposition system comprising:

an electrodeposition bath including a non-aqueous liquid, wherein the non-aqueous liquid is an ionic liquid; and an optionally substituted aromatic hydrocarbon, wherein the optionally substituted aromatic hydrocarbon is protonated;

an anode at least partially immersed in the electrodeposition bath; and a cathode at least partially immersed in the electrodeposition bath.

* * * * *